US010480461B2

(12) United States Patent
Honda

(10) Patent No.: US 10,480,461 B2
(45) Date of Patent: Nov. 19, 2019

(54) COMBUSTION ASSIST DEVICE FOR INTERNAL COMBUSTION ENGINE

(71) Applicant: Mitsubishi Electric Corporation, Tokyo (JP)

(72) Inventor: Tetsuya Honda, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 214 days.

(21) Appl. No.: 15/639,407

(22) Filed: Jun. 30, 2017

(65) Prior Publication Data

US 2018/0058393 A1 Mar. 1, 2018

(30) Foreign Application Priority Data

Aug. 24, 2016 (JP) ..... 2016-163371

(51) Int. Cl.
*F02M 27/04* (2006.01)
*F02M 61/14* (2006.01)

(52) U.S. Cl.
CPC ..... *F02M 27/042* (2013.01); *F02M 61/145* (2013.01)

(58) Field of Classification Search
CPC ..... F02B 11/00; F02B 19/12; F02B 23/08; F02B 27/04; F02D 13/02; F02D 41/04; F02D 43/00; F02M 27/042; F02M 61/14; F02M 61/145
See application file for complete search history.

(56) References Cited

U.S. PATENT DOCUMENTS

2005/0126550 A1* 6/2005 Varasundharosoth ..... F02M 25/0836 123/539
2011/0214647 A1* 9/2011 Clack ..... F02M 25/12 123/537
2011/0247596 A1* 10/2011 Clack ..... F02M 27/02 123/539

(Continued)

FOREIGN PATENT DOCUMENTS

JP 2-191858 A 7/1990
JP 2007-107491 A 4/2007
JP 2013-148098 A 8/2013

OTHER PUBLICATIONS

Communication dated Jul. 18, 2017, issued from the Japan Patent Office in the counterpart Application No. 2016-163371.

*Primary Examiner* — John Kwon
*Assistant Examiner* — Johnny H Hoang
(74) *Attorney, Agent, or Firm* — Sughrue Mion, PLLC; Richard C. Turner

(57) ABSTRACT

A combustion assist device is provided in an internal combustion engine provided with a fuel injector for injecting at least a portion of fuel into an intake manifold. Further, the combustion assist device is provided with an electrode element which is provided in the intake manifold and to which a high frequency high voltage is applied. The electrode element includes a dielectric material plate, a first metal conductor, and a second metal conductor. The dielectric material plate includes a first surface and a second surface, and divides a portion of the intake manifold into a first flow path on a first surface side and a second flow path on a second surface side. The first metal conductor is provided on the first surface. The second metal conductor is provided on the second surface.

6 Claims, 4 Drawing Sheets

(56) References Cited

U.S. PATENT DOCUMENTS

| | | | | |
|---|---|---|---|---|
| 2012/0318245 | A1* | 12/2012 | Clack | F02M 27/02 123/537 |
| 2016/0252031 | A1* | 9/2016 | Nagatsu | F02D 41/0057 123/305 |
| 2018/0283323 | A1* | 10/2018 | Wada | F02D 9/02 |

* cited by examiner

COMBUSTION ASSIST DEVICE FOR INTERNAL COMBUSTION ENGINE

BACKGROUND OF THE INVENTION

1. Field of the Invention

The present invention relates to a combustion assist device provided in an internal combustion engine, in which at least a portion of fuel is injected into an intake manifold, and assisting combustion of fuel.

2. Description of the Related Art

In conventional internal combustion engines that use gasoline as fuel, air is introduced into a combustion chamber in an amount that is appropriate for an amount of fuel introduced into the combustion chamber. Spark discharge energy is then applied to the mixture of fuel and air formed in the combustion chamber, combustion is induced, and the energy generated as a result is taken out as power.

Further, a technique is known in which temperature and pressure is controlled so that the mixture of fuel and air formed inside the combustion chamber self-ignites without applying spark discharge energy thereto, whereby combustion is induced, and the energy generated as a result is taken out as power.

With either of the combustion modes described above, the combustion state may become unstable due to the influence of the temperature, concentration, flow strength, and so forth of the air-fuel mixture formed in the combustion chamber.

When the combustion state becomes unstable, the traveling speed of a vehicle using the internal combustion engine for power becomes unstable and, in addition, fuel economy decreases, such that it is desirable to make the combustion state as stable as possible.

As a method of making the combustion state more stable, in a conventional method for improving the combustive properties of an internal combustion engine, a high voltage is applied between two discharge electrodes that project into the intake manifold of an internal combustion engine, causing a discharge to be generated between the electrodes. High temperature plasma is generated by this discharge such that ozone is generated from oxygen in the air, and this ozone is added to the air-fuel mixture (see Japanese Patent Application Publication No. H2-191858, for example).

Further, in a conventional engine ignition control device, a portion of injected fuel comes into contact with a discharge electrode, thereby generating an active chemical species having a high reactivity. By adding the generated active chemical species to the air-fuel mixture, ignitability of the air-fuel mixture is improved (see, Japanese Patent Application Publication No. 2013-148098, for example).

SUMMARY OF THE INVENTION

With the conventional technique disclosed in Japanese Patent Application Publication No. H2-191858, if the generated ozone does not move away from the high temperature plasma due to air flow or the like, the ozone state cannot be maintained due to the heat of the plasma, and the ozone reverts back to oxygen.

Ozone generated during an intake stroke moves rapidly away from the high temperature plasma due to the intake flow, however, in internal combustion engines of a type in which fuel is injected into the intake manifold, fuel and air are mixed in a part of the intake manifold during the intake stroke, such that it is necessary to install the electrodes in an upstream portion of the intake manifold that is removed from the combustion chamber in order to prevent ignition of the fuel in the intake manifold. In such a case, a cycle delay occurs while the generated ozone reaches the combustion chamber, hence a problem exists in that control responsiveness cannot be ensured.

Further, with the conventional technique disclosed in Japanese Patent Application Publication No. 2013-148098, a low temperature plasma discharge is generated, such that there is a low possibility of the fuel igniting in the intake manifold and, due to generation of the active chemical species at a location proximate to the combustion chamber, control responsiveness can be ensured. However, as a discharge electrode having a structure similar to that of a conventional spark plug is used, an amount of the active chemical species generated by contact with the low temperature plasma is not necessarily large. Moreover, although ozone is generated when oxygen in the air comes into contact with the low temperature plasma, an amount thereof is, likewise, small.

The present invention has been made to solve the problems described above, and an object thereof is to obtain a combustion assist device for an internal combustion engine that, while ensuring control responsiveness, generates a sufficient amount of ozone and enables a combustion state to be stabilised in a combustion engine in which fuel is injected into an intake manifold.

A combustion assist device for an internal combustion engine according to the present invention is a combustion assist device provided in an internal combustion engine provided with a fuel injector for injecting at least a portion of fuel into an intake manifold, the combustion assist device including an electrode element which is provided in the intake manifold and to which a high frequency high voltage is applied, wherein the electrode element includes a dielectric material plate which has a first surface and a second surface, which is a surface on an opposite side to the first surface, the dielectric material plate dividing a portion of the intake manifold into a first flow path on a side of the first surface and a second flow path on a side of the second surface, a first metal conductor, which is a metal conductor film provided on the first surface, and a second metal conductor, which is a metal conductor provided on the second surface.

The combustion assist device for an internal combustion engine according to the present invention uses an electrode element that includes a dielectric material plate, a first metal conductor provided on a first surface of the dielectric material plate, and a second metal conductor provided on a second surface of the dielectric material plate, and divides a portion of an intake manifold into a first flow path on a side the first surface and a second flow path on a side of the second surface by means of the dielectric material plate, such that the combustion assist device, while ensuring control responsiveness, generates a sufficient amount of ozone and enables a combustion state to be stabilized in a combustion engine in which fuel is injected into the intake manifold.

DESCRIPTION OF THE PREFERRED EMBODIMENTS

Embodiments of the present invention will be described hereinafter with reference to the drawings.

First Embodiment

Figure 1:
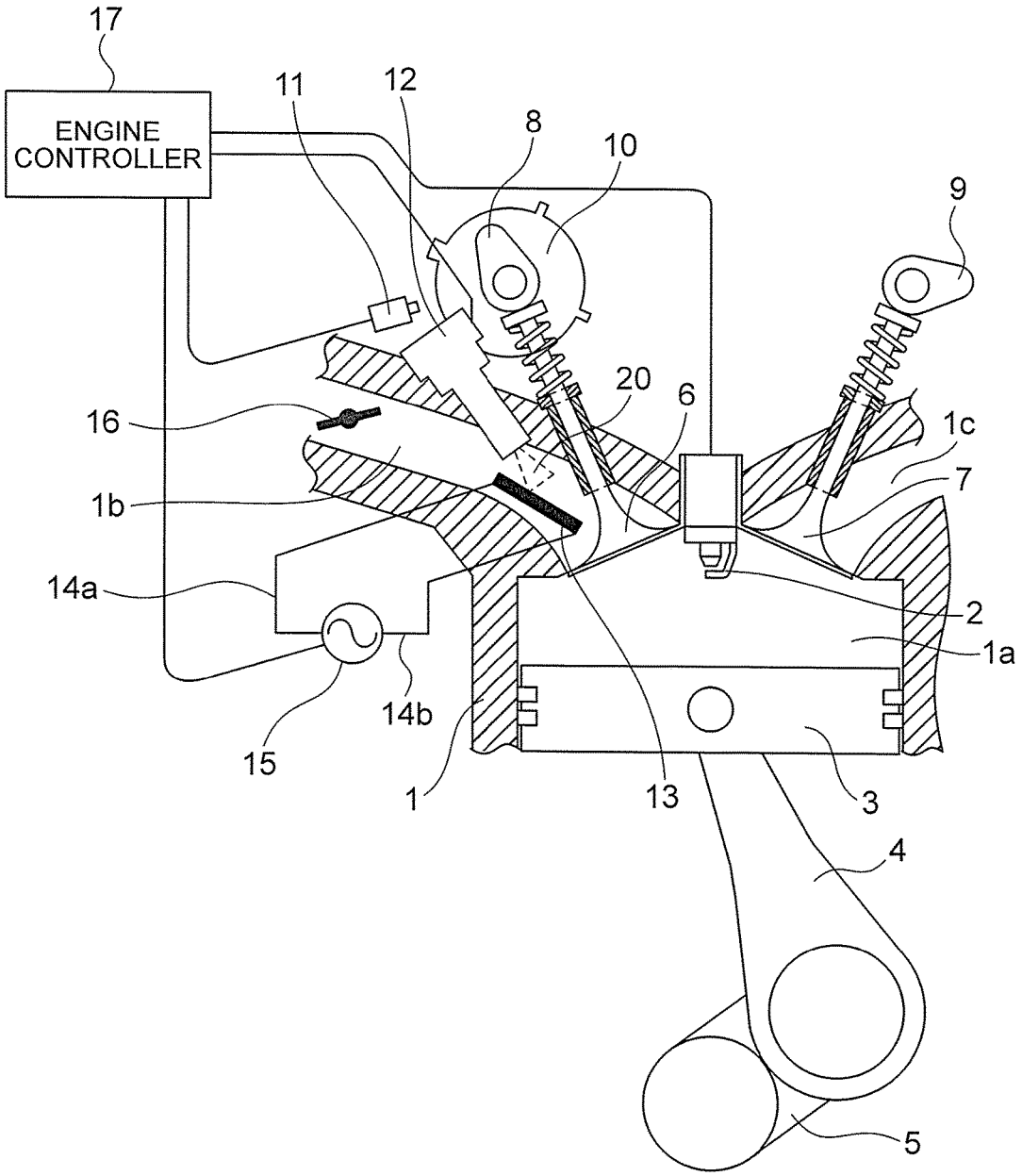
FIG. 1 is a configuration diagram showing the main components of an internal combustion engine according to a first embodiment of the present invention.

FIG. 1 is a configuration diagram showing the main components of an internal combustion engine according to a first embodiment of the present invention. Note that, in internal combustion engines used for driving vehicles and the like, intake manifolds are respectively provided for a plurality of combustion chambers. Here however, the configuration of one intake manifold only is shown in order to simplify explanation of operations.

In the drawing, an internal combustion engine main body 1 is provided with a combustion space 1*a*, and an intake manifold 1*b* and an exhaust manifold 1*c* connected to the combustion space 1*a*. Further, a spark plug 2 is provided in the internal combustion engine main body 1 so as to face the combustion space 1*a*.

A piston 3 is provided in the combustion space 1*a*. The piston 3 is coupled to a crank 5 via a connecting rod 4.

The internal combustion engine main body 1 is provided with an intake valve 6 that opens and closes between the intake manifold 1*b* and the combustion space 1*a* and an exhaust valve 7 that opens and closes between the exhaust manifold 1*c* and the combustion space 1*a*. The intake valve 6 opens and closes due to the rotation of an intake cam 8. The exhaust valve 7 opens and closes due to the rotation of an exhaust cam 9.

A cam angle signal plate 10 rotates in synchronization with the intake cam 8. The rotation angle of the intake cam 8 is detected by a cam angle sensor 11 which faces the cam angle signal plate 10. A gap sensor, for example, is used as the cam angle sensor 11.

The internal combustion engine main body 1 is provided with a fuel injector 12 for injecting at least a portion of fuel into the intake manifold 1*b*. An electrode element 13 is provided in the intake manifold 1*b* at a position that faces the fuel injector 12. The electrode element 13 is connected to a power supply device 15 via a pair of power supply conducting wires 14*a* and 14*b*. A throttle valve 16 is provided upstream from the electrode element 13 in the intake manifold 1*b*.

A signal from the cam angle sensor 11 is input to an engine controller 17. The engine controller 17 controls the spark plug 2, the fuel injector 12, and the power supply device 15.

The combustion assist device for an internal combustion engine according to the first embodiment includes the electrode element 13, the power supply conducting wires 14*a* and 14*b*, the power supply device 15, and the engine controller 17.

Next, basic operations of internal combustion engines having a form in which fuel is injected into the intake manifold 1*b* of each cylinder thereof will be described. The piston 3 respectively provided in each cylinder of the internal combustion engine main body 1 reciprocates, due to the action of the crank 5 and the connecting rod 4, so as to increase or decrease the volume of the combustion space 1*a*.

In four-stroke internal combustion engines, the intake cam 8 and the exhaust cam 9 are set to rotate once with respect to two rotations of the crank 5. As a result, during one of two reciprocations of the piston 3, the exhaust valve 7 mainly opens during a stroke in which the volume of the combustion space 1*a* decreases, and the intake valve 6 mainly opens during a continuing stroke in which the volume of the combustion space 1*a* increases.

In many cases, in internal combustion engines that use gasoline as fuel, fuel 20 is injected into the intake manifold 1*b* from the fuel injector 12 provided in each cylinder before the intake valve 6 starts to open. The engine controller 17 identifies fuel injection timings on the basis of, for example, the cam rotation angle detected by the cam angle sensor 11 or information relating to the crank rotation angle, and transmits an injection control signal to the fuel injector 12.

When the intake valve 6 is closed, the injected fuel remains in the intake manifold 1*b*. Thereafter, when the intake valve 6 starts to open, air, the flow rate of which has been adjusted by the throttle valve 16, is sucked into the combustion space 1*a* through the intake manifold 1*b*, such that the fuel remaining in the intake manifold 1*b* is also sucked into the combustion space 1*a*.

The air and fuel sucked into the combustion space 1*a* are mixed together and compressed by the piston 3 while forming a homogeneous combustible air-fuel mixture. In the latter half of compression, the spark plug 2 generates a spark discharge on the basis of a control signal from the engine controller 17 so as to forcibly ignite the compressed combustible air-fuel mixture.

When the combustible air-fuel mixture begins to combust, pressure in the combustion space 1*a* rises and pressure energy thereof pushes back the piston 3, whereby rotational energy is taken out to the outside of the engine via the connecting rod 4 and the crank 5.

The combusted combustible air-fuel mixture is discharged to the outside of the internal combustion engine through the exhaust manifold 1*c* during the period in which the exhaust valve 7 is open.

Figure 2:
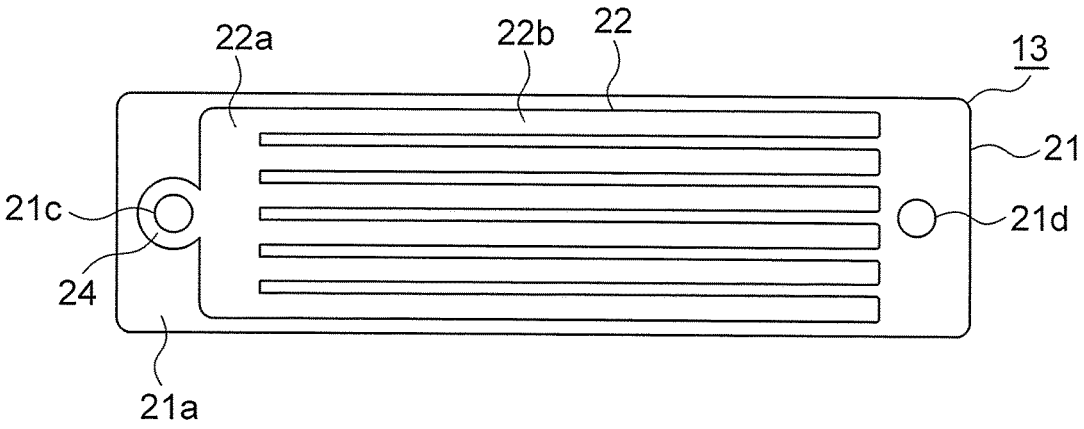
FIG. 2 is a front view showing an electrode element in FIG. 1.
Figure 3:
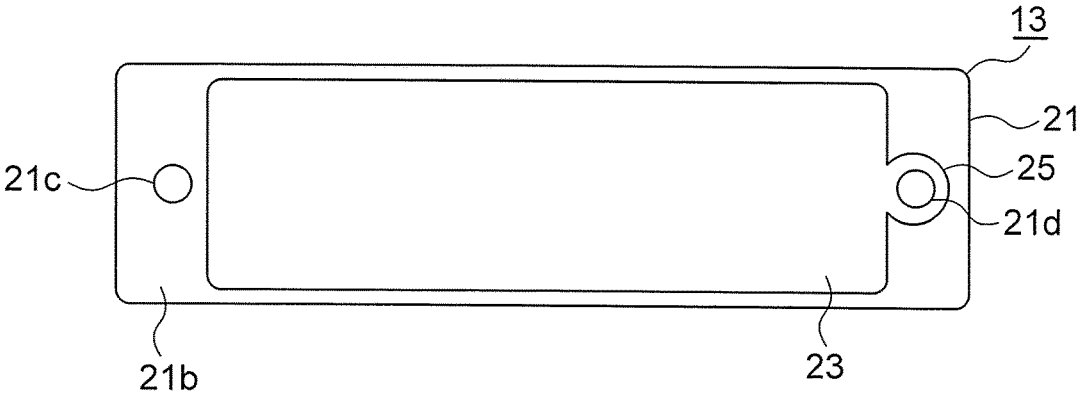
FIG. 3 is a rear view showing the electrode element in FIG. 1.

FIG. 2 is a front view showing the electrode element 13 in FIG. 1, and FIG. 3 is a rear view showing the electrode element 13 in FIG. 1. The electrode element 13 includes a dielectric material plate 21, a first metal conductor 22, and a second metal conductor 23.

The dielectric material plate 21 is constituted by a dielectric material such as ceramic. Further, the planar shape of the dielectric material plate 21 is a rectangular shape having a long side and a short side. Moreover, the dielectric material plate 21 includes a first surface 21*a*, which is a front surface, and a second surface 21*b* which is a surface on an opposite side to the first surface 21*a*, which is a rear surface.

The first metal conductor 22 is a metal film adhered to the first surface 21*a* without any gaps therebetween. The first metal conductor 22 includes a rectangular base end portion 22*a* provided in the vicinity of one end portion of the dielectric material plate 21 in the longitudinal direction and a plurality of linear portions 22*b* that project from the base end portion 22*a* towards the other end portion of the dielectric material plate 21 in the longitudinal direction.

The linear portions 22*b* are provided in parallel to each other and are separated from each other in a direction perpendicular to the longitudinal direction of the dielectric material plate 21 by gaps. In other words, the planar shape of the first metal conductor 22 is a comb shape.

The second metal conductor 23 is a metal film adhered to the second surface 21*b* without any gaps therebetween, and is not in contact with the first metal conductor 22. Further, the planar shape of the second metal conductor 23 is a rectangular shape which is smaller than the dielectric material plate 21.

As described above, the planar shape of the first metal conductor 22 is a comb shape, and the second metal conductor 23 has a rectangular shape, such that an edge of the first metal conductor 22 is longer than an edge of the second metal conductor 23.

Copper, aluminum, or gold, for example, is used as a material for the first and second metal conductors 22 and 23. In addition, the first and second metal conductors 22 and 23 are formed on the dielectric material plate 21 by, for example, vapor deposition.

First and second connection holes 21*c* and 21*d* are provided at both end portions of the dielectric material plate 21 in the longitudinal direction. An annular first connecting portion 24, to which one of the power supply conducting wires 14*a* is connected, is provided around the periphery of the first connection hole 21*c* on the first surface 21*a*. The first connecting portion 24 is electrically connected to the first metal conductor 22.

An annular second connecting portion 25, to which the other power supply conducting wire 14*b* is connected, is provided around the periphery of the second connection hole 21*d* on the second surface 21*b*. The second connecting portion 25 is electrically connected to the second metal conductor 23.

When high frequency and high voltage energy is output from the power supply device 15, low temperature plasma discharges are generated at the respective edge portions of the first metal conductor 22 and the second metal conductor 23.

The electrode element 13 is disposed at a position that is reached by least a portion of unevaporated fuel particles of the injected fuel 20 injected from the fuel injector 12. The unevaporated fuel particles having reached the electrode element 13 temporarily adhere to the surface of the electrode element 13.

Figure 4:
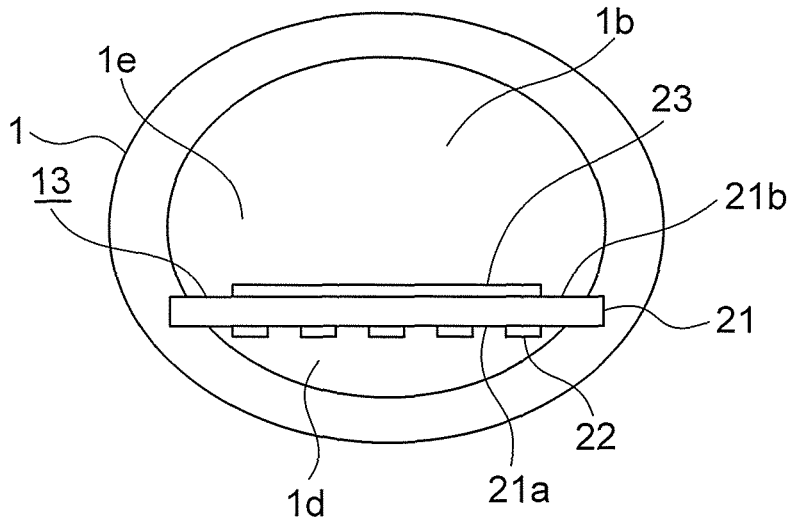
FIG. 4 is a cross-sectional view showing an example arrangement of the electrode element with respect to an intake manifold in FIG. 1.

FIG. 4 is a cross-sectional view showing an example arrangement of the electrode element 13 with respect to the intake manifold 1*b* in FIG. 1. A portion of the intake manifold 1*b* in which the electrode element 13 is disposed is divided by the dielectric material plate 21 into a first flow path 1*d* on a first surface 21*a* side and a second flow path 1*e* on a second surface 21*b* side. Further, the electrode element 13 is disposed so that the second surface 21*b*, on which the second metal conductor 23 having a short edge distance is provided, faces the fuel injector 12.

By disposing the electrode element 13 in this way, oxygen contained in the air passes through the first flow path 1*d* during the intake stroke and, at times other than the intake stroke, remains in the first flow path 1*d*, and by coming into contact with a low temperature plasma discharge on a first metal conductor 22 side, which is more active than a second metal conductor 23 side, a larger amount of ozone is generated.

Meanwhile, in the second flow path 1*e*, heat generated by a low temperature plasma discharge and the high thermal conductivity of the second metal conductor 23 are utilized to promote vaporization of unevaporated fuel adhered to the surface of the second metal conductor 23, concentration homogenization of the air-fuel mixture formed from the fuel and air introduced into the combustion space 1*a* progresses, and an improvement in combustion efficiency is realized.

Here, when a high-frequency alternating voltage is applied from the power supply device 15 to the electrode element 13, low temperature plasma discharges occur alternately at both of the edges of the first metal conductor 22 and the second metal conductor 23. For this reason, there is a possibility that the fuel could be ignited by a discharge generated at a contour portion of the second metal conductor 23 which faces the fuel injector 12.

In order to prevent such ignition of the fuel, the power supply device 15 stops applying the high frequency alternating voltage to the electrode element 13 before the fuel injected from the fuel injector 12 during a cycle reaches the electrode element 13.

As another method of preventing fuel ignition, a method exists in which a potential of the second metal conductor 23 is constantly fixed to the zero potential of the power supply device 15, and the power supply device 15 applies a half-wave potential only to the first metal conductor 22. With this method, the power supply device 15 does not need to stop applying a high frequency half-wave voltage to the electrode element 13 before the fuel injected from the fuel injector 12 during a cycle reaches the electrode element 13.

In such a combustion assist device for an internal combustion engine, the electrode element 13 which includes the dielectric material plate 21, the first metal conductor 22 provided on the first surface 21*a* of the dielectric material plate 21, and the second metal conductor 23 provided on the second surface 21*b* of the dielectric material plate 21 is used and a portion of the intake manifold 1*b* is divided into the first flow path 1*d* and the second flow path 1*e* by means of the dielectric material plate 21, such that the combustion assist device, while ensuring control responsiveness, generates a sufficient amount of ozone and enables a combustion state to be stabilized in a combustion engine in which the fuel 20 is injected into the intake manifold 1*b*.

In addition, as the electrode element 13 is disposed at a position directly reached by at least a portion of the unevaporated fuel particles of the injected fuel 20 injected from the fuel injector 12, vaporization of the unevaporated fuel adhered to the surface of the second metal conductor 23 can be promoted by utilizing heat generated by a low temperature plasma discharge and the high thermal conductivity of the second metal conductor 23. As a result, it is also possible for the second metal conductor 23 to be cooled.

Further, as the distance of the edge of the first metal conductor 22 is longer than that of the edge of second metal conductor 23, a larger amount of ozone can be generated by a low temperature plasma discharge at the first metal conductor 22 side.

Second Embodiment

Figure 5:
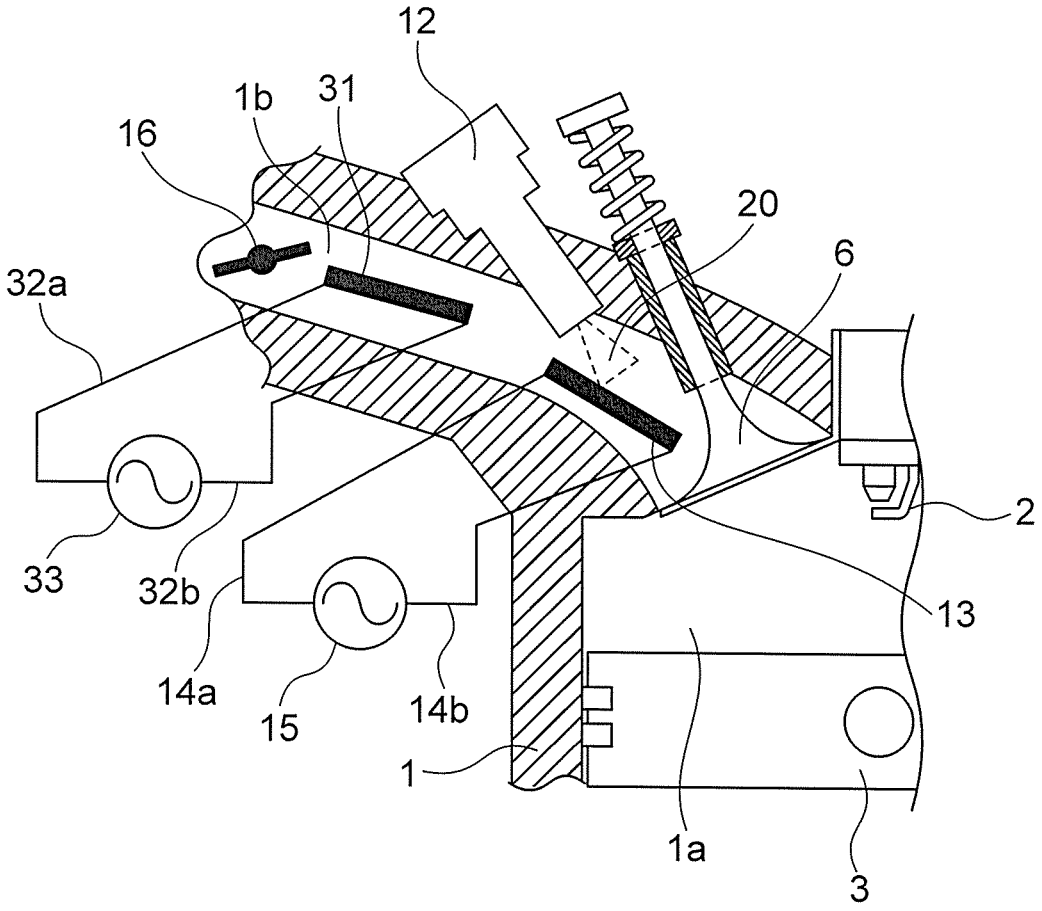
FIG. 5 is a configuration diagram showing the main components of an internal combustion engine according to a second embodiment of the present invention.

Next, FIG. 5 is a configuration diagram showing the main components of an internal combustion engine according to a second embodiment of the present invention. In the second embodiment, an auxiliary element 31 is provided upstream from the electrode element 13 and downstream from the throttle valve 16 in the intake manifold 1*b*. In this example, an element having the same configuration as the electrode element 13 shown in FIGS. 2 and 3 is used as the auxiliary element 31. In other words, the auxiliary element 31, in the same way as the electrode element 13, includes the dielectric material plate 21, the first metal conductor 22, and the second metal conductor 23. However, in the auxiliary element 31, the shape of the second metal conductor 23 may be the same as that of the first metal conductor 22.

The auxiliary element 31 is connected to an auxiliary element power supply device 33 via a pair of auxiliary conductive wires 32*a* and 32*b*. High frequency high voltage energy from the auxiliary element power supply device 33 is supplied to the auxiliary element 31. As a result, it is possible for ozone to be generated in a portion of the intake manifold 1*b* that is upstream from the electrode element 13.

The combustion assist device of the second embodiment includes, in addition to the combustion assist device of the first embodiment, the auxiliary element 31, the auxiliary conductive wires 32*a* and 32*b*, and the auxiliary element power supply device 33. Other configurations and operations are similar or identical to those of the first embodiment.

Ozone generation by the auxiliary element 31 is used to compensate for the insufficiency of ozone generation by the electrode element 13. In other words, as the control responsiveness of an amount of ozone supplied to the combustion space 1*a* by the electrode element 13, which is proximate to combustion space 1*a*, is good, a required amount of ozone is constantly and quantitatively supplied by the auxiliary element 31, and the ozone supply amount is quickly changed in accordance with changes in combustion conditions by the electrode element 13. As a result, stabilization of the combustion state can be further improved.

Here, element temperatures of both the electrode element 13 and the auxiliary element 31 rise due to the low temperature plasma discharges. In the electrode element 13, cooling is performed by utilizing the surrounding air flow and the heat of vaporization of unevaporated fuel adhered to the surface thereof, however, in the auxiliary element 31, cooling is performed only by the surrounding air flow. Accordingly, in the auxiliary element 31, it is necessary to keep an element heat generation density, which is the amount of heat generated per unit area, lower than that of the electrode element 13.

As a method of suppressing the heat generation density of the auxiliary element 31, a method exists in which, when a value obtained by dividing an amount of energy input (W), by a total distance (m) of an edge of a metal conductor generating a low temperature plasma discharge, and an energy input time (sec) (W/(m·sec)) is set as an evaluation value, an evaluation value relating to the auxiliary element 31 is set to be lower than an evaluation value relating to the electrode element 13.

Note that, in the first and second embodiments, the shape of the first metal conductor 22 is a comb shape, however, other shapes may also be adopted as long as an edge length thereof can be made long. For example, a comb shape in which linear portions are parallel to the short side of the dielectric material plate, a spiral shape, or a serpentine shape may be used.

Moreover, the length of the edge of the first metal conductor and the length of the edge of the second metal conductor do not necessarily have to be different from each other.

Further, the position of the electrode element does not necessarily have to be a position directly reached by fuel from the fuel injector.

What is claimed is:

1. A combustion assist device for an internal combustion engine provided with a fuel injector for injecting at least a portion of fuel into an intake manifold, the combustion assist device comprising:

an electrode element which is provided in the intake manifold and to which a high frequency high voltage is applied, wherein the electrode element includes:

a dielectric material plate which has a first surface and a second surface, which is a surface on an opposite side to the first surface, the dielectric material plate dividing a portion of the intake manifold into a first flow path on a side of the first surface and a second flow path on a side of the second surface, a first metal conductor which is a metal conductor provided on the first surface, a second metal conductor which is a metal conductor provided on the second surface, and wherein the electrode element is disposed at a position directly reached by at least a portion of unevaporated fuel of the fuel injected from the fuel injector.

2. The combustion assist device for an internal combustion engine according to claim 1, wherein a distance of an edge of the first metal conductor is greater than a distance of an edge of the second metal conductor.

3. The combustion assist device for an internal combustion engine according to claim 2, wherein the second surface faces the fuel injector.

4. The combustion assist device for an internal combustion engine according to claim 1, further comprising:

a power supply device which applies a high frequency high voltage to the first and second metal conductors, and a controller for controlling the power supply device, wherein the controller stops applying the high frequency high voltage before at least a portion of the fuel injected from the fuel injector during a cycle reaches the electrode element.

5. The combustion assist device for an internal combustion engine according to claim 1, further comprising:

a power supply device which applies the high frequency high voltage to the first and second metal conductors, wherein of the first and second metal conductors, the metal conductor on a side that faces the fuel injector is maintained at zero-volt potential of the power supply device, and the power supply device applies the high frequency high voltage to the metal conductor on a side that does not face the fuel injector.

6. The combustion assist device for an internal combustion engine according to claim 1, further comprising:

an auxiliary element which, in the same way as the electrode element, includes the dielectric material plate, the first metal conductor, and the second metal conductor, and is provided upstream from the electrode element in the intake manifold, wherein a high frequency high voltage applied to the auxiliary element is set such that an amount of heat generated per unit area thereof is less than that of the electrode element.

* * * * *